US012584430B2

(12) United States Patent
Shimizu

(10) Patent No.: US 12,584,430 B2
(45) Date of Patent: Mar. 24, 2026

(54) EXHAUST PURIFICATION APPARATUS

(71) Applicant: SUBARU CORPORATION, Tokyo (JP)

(72) Inventor: Shingo Shimizu, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 19/201,432

(22) Filed: May 7, 2025

(65) Prior Publication Data

US 2025/0354507 A1 Nov. 20, 2025

(30) Foreign Application Priority Data

May 16, 2024 (JP) ..... 2024-080523

(51) Int. Cl.
*F01N 3/031* (2006.01)

(52) U.S. Cl.
CPC ..... *F01N 3/031* (2013.01); *F01N 2410/08* (2013.01)

(58) Field of Classification Search
CPC ..... F01N 3/005; F01N 3/031; F01N 3/038; F01N 13/12; F01N 2240/22; F01N 2410/08; F01N 2570/22
See application file for complete search history.

(56) References Cited

U.S. PATENT DOCUMENTS 5,181,943 A * 1/1993 Weber ..... B01D 50/00 95/271
6,024,617 A * 2/2000 Smullin ..... F01N 1/02 440/89 R
2002/0090907 A1* 7/2002 Barber ..... B01D 46/521 62/317
2014/0291067 A1* 10/2014 Mukai ..... F01N 1/08 181/228
2018/0179943 A1* 6/2018 Oya ..... F01N 3/005

FOREIGN PATENT DOCUMENTS

JP 2015-222028 A 12/2015
KR 102542321 B1 * 6/2023 ..... F01N 3/031

* cited by examiner

*Primary Examiner* — Jonathan R Matthias
(74) *Attorney, Agent, or Firm* — Finnegan, Henderson, Farabow, Garrett & Dunner, LLP

(57) ABSTRACT

An exhaust purification apparatus includes a particulate filter, first and second exhaust passages. The particulate filter removes particulate matter. The first and second exhaust passages are coupled in parallel and coupled to an exhaust passage. The first exhaust passage communicates with a tail pipe via a secondary filter in an initial state of the particulate filter. After a start of use of the particulate filter, communication of the first exhaust passage with the tail pipe is blocked when the secondary filter is clogged with the particulate matter. The second exhaust passage is closed in the initial state. After the start, the second exhaust passage communicates with the tail pipe when the secondary filter is clogged with the particulate matter to cause an increase in pressure loss of the secondary filter and an increase in an exhaust pressure, and thus discharge of the liquid and/or evaporation of the liquid occurs.

5 Claims, 5 Drawing Sheets

[STATE AT START OF USE (INITIAL STATE)]

EXHAUST PURIFICATION APPARATUS

CROSS-REFERENCE TO RELATED APPLICATIONS

The present application claims priority from Japanese Patent Application No. 2024-080523 filed on May 16, 2024, the entire contents of which are hereby incorporated by reference.

BACKGROUND OF THE INVENTION

Field of the Invention

The disclosure relates to an exhaust purification apparatus.

Description of Background Art

Japanese Unexamined Patent Application Publication No. 2015-222028 describes a gasoline particulate filter (GPF). The entire contents of this publication are incorporated herein by reference.

SUMMARY OF THE INVENTION

According to one aspect of the disclosure, an exhaust purification apparatus for purifying exhaust gas discharged from an engine includes a particulate filter that collects and removes particulate matter, secondary filter that collects and removes the particulate matter, and exhaust passages including a first exhaust passage and a second exhaust passage coupled in parallel to each other and coupled to an exhaust passage on a downstream side of the particulate filter. The first exhaust passage communicates with a tail pipe via the secondary filter in an initial state of the particulate filter, and the second exhaust passage is closed by a liquid in the initial state of the particulate filter and communicates with the tail pipe after the start of use of the particulate filter when the secondary filter is clogged with the particulate matter and communication of the first exhaust passage with the tail pipe is blocked to cause an increase in pressure loss of the secondary filter and an increase in an exhaust pressure such that discharge of the liquid and/or evaporation of the liquid occurs.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
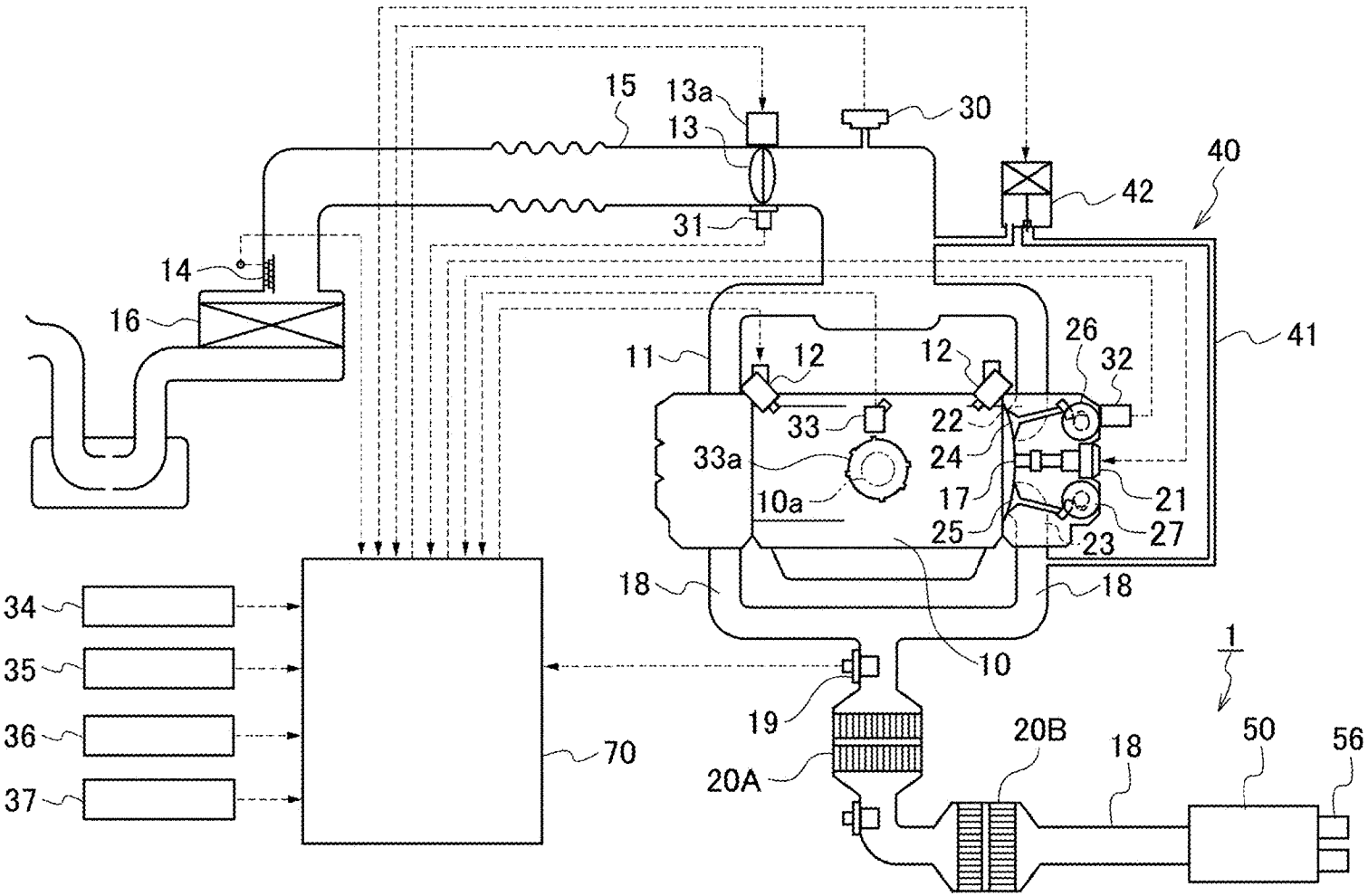
FIG. 1 is a view illustrating configurations of an exhaust purification apparatus according to an embodiment and an engine, to which the exhaust purification apparatus is applied.

Embodiments will now be described with reference to the accompanying drawings, wherein like reference numerals designate corresponding or identical elements throughout the various drawings.

The following description is an illustrative example of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiment which are not recited in a most-generic independent claim of the disclosure are optional and may be provided on an as-needed basis.

Figure 2:
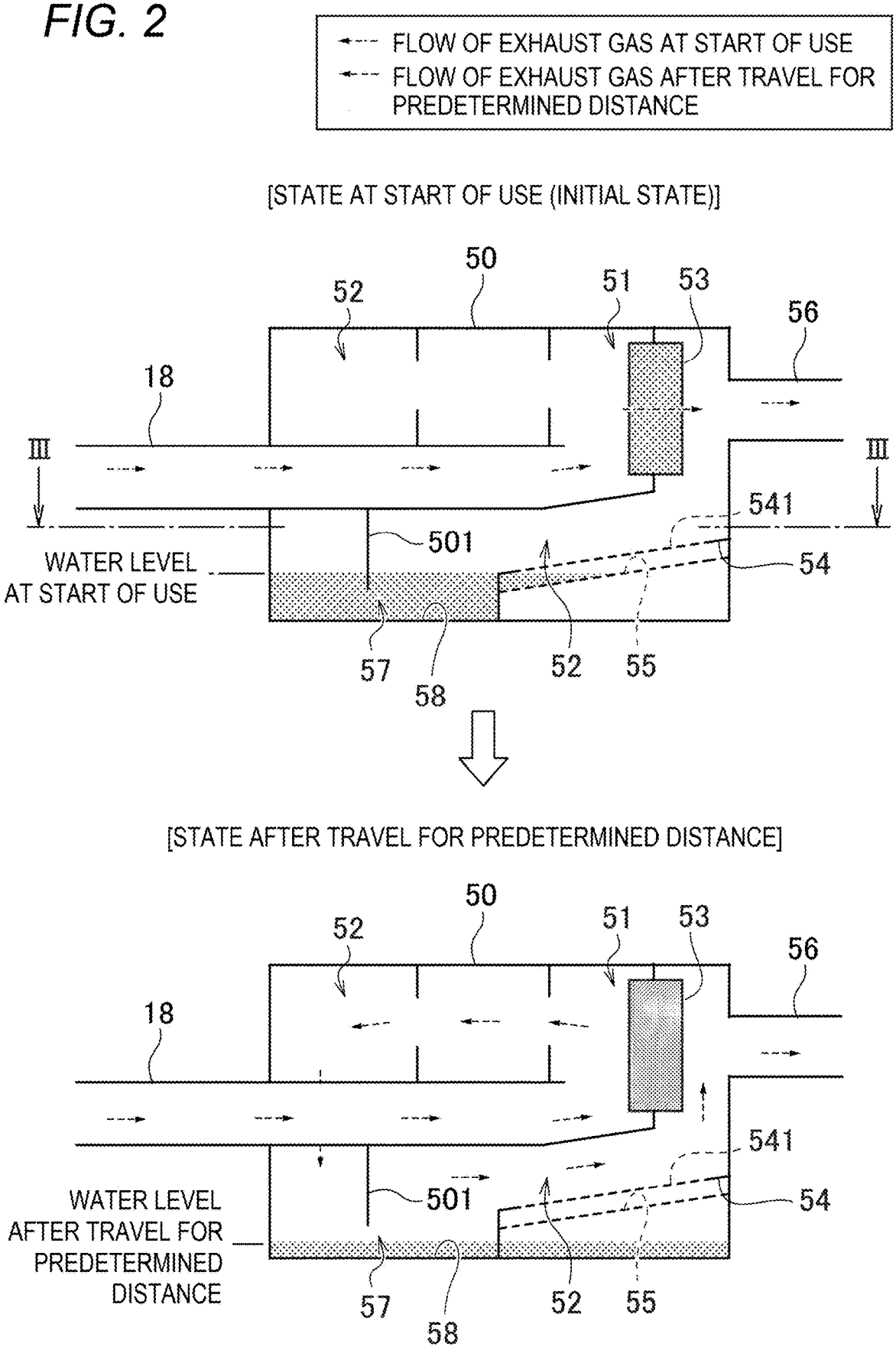
FIG. 2 includes cross-sectional views, each of which illustrates a configuration of a muffler constituting the exhaust purification apparatus according to the embodiment.
Figure 3:
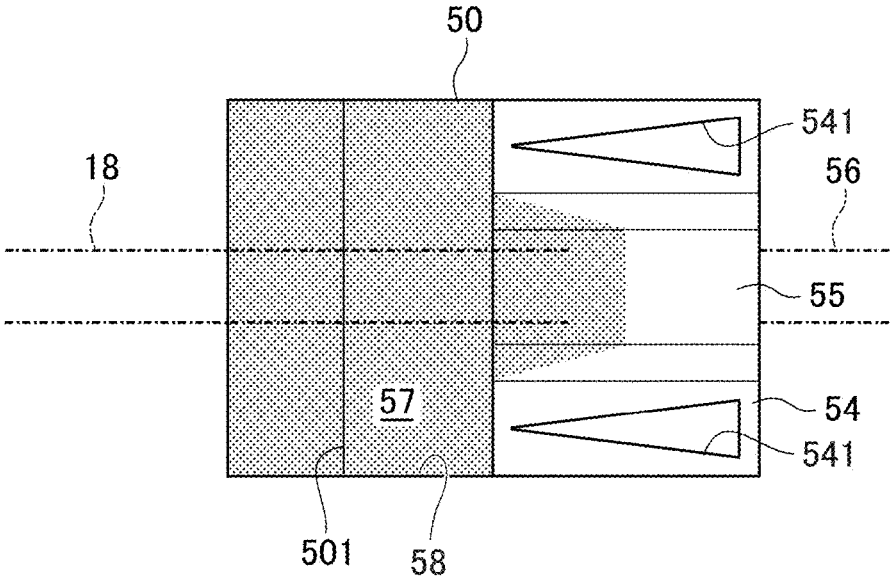
FIG. 3 includes a front view and a plan view, each of which illustrates the configuration of the muffler constituting the exhaust purification apparatus according to the embodiment.
Figure 3:
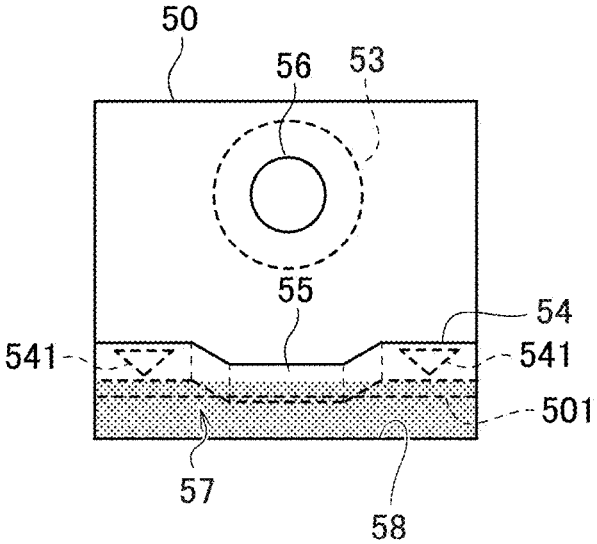

First, a description will be made on a configuration of an exhaust purification apparatus 1 according to an embodiment with reference to FIG. 1 to FIG. 3. FIG. 1 is a view illustrating the configuration of the exhaust purification apparatus 1 and a configuration of an engine 10, to which the exhaust purification apparatus 1 is applied. FIG. 2 includes cross-sectional views, each of which illustrates a configuration of a muffler 50 constituting the exhaust purification apparatus 1. In FIG. 2, a state of the muffler 50 at a start of use (an initial state) is illustrated in an upper part, and a state thereof after travel for a predetermined distance is illustrated in a lower part. FIG. 3 includes a front view and a plan view (a cross-sectional view that is taken along line III-III in FIG. 2), each of which illustrates the configuration of the muffler 50 constituting the exhaust purification apparatus 1.

The engine 10 is a horizontally-opposed, four-cylinder gasoline engine, for example. The engine 10 is also a cylinder injection engine that directly injects fuel into the cylinders. In the engine 10, a flow of air that is suctioned from an air cleaner 16 is reduced by an electronically-controlled throttle valve (hereinafter also simply referred to as a "throttle valve") 13 provided in an intake pipe 15, and is then suctioned into each of the cylinders provided in the engine 10 via an intake manifold 11. An amount of the air that is suctioned from the air cleaner 16 is detected by an airflow meter 14 disposed between the air cleaner 16 and the throttle valve 13. In a collector (a surge tank) that constitutes the intake manifold 11, a vacuum sensor 30 is disposed to detect a pressure in the intake manifold 11 (an intake manifold pressure). Furthermore, the throttle valve 13 has a throttle opening degree sensor 31 that detects an opening degree of the throttle valve 13.

In a cylinder head, an intake port 22 and an exhaust port 23 are provided to each of the cylinders (FIG. 1 illustrates one bank). The intake port 22 and the exhaust port 23 respectively include an intake valve 24 and an exhaust valve 25 that respectively open/close the intake port 22 and the exhaust port 23. A variable valve timing mechanism 26 is disposed between an intake cam shaft and an intake cam pulley that drive the intake valve 24. The variable valve timing mechanism 26 causes the intake cam pulley and the intake cam shaft to rotate relative to each other, and thereby continuously changes a rotation phase (a displacement angle) of the intake cam shaft with respect to a crankshaft 10*a*. In this way, the variable valve timing mechanism 26 advances/delays a valve timing (an opening/closing timing) of the intake valve 24. This variable valve timing mechanism 26 sets the opening/closing timing of the intake valve 24 to be variable according to an engine driving state.

Similarly, a variable valve timing mechanism 27 is disposed between an exhaust cam shaft and an exhaust cam pulley. The variable valve timing mechanism 27 causes the exhaust cam pulley and the exhaust cam shaft to rotate relative to each other, and thereby continuously changes a rotation phase (a displacement angle) of the exhaust cam shaft with respect to the crankshaft 10*a*. In this way, the variable valve timing mechanism 27 advances/delays a valve timing (an opening/closing timing) of the exhaust valve 25. This variable valve timing mechanism 27 sets the opening/closing timing of the exhaust valve 25 to be variable according to the engine driving state.

An injector 12 is attached to each of the cylinders in the engine 10, and injects the fuel into the respective cylinder. The injector 12 directly injects the fuel, which has been pressurized by a high-pressure fuel pump (not illustrated), into a combustion chamber of the respective cylinder.

An ignition plug 17 and an ignitor-installed coil 21 are attached to the cylinder head of each of the cylinders. The ignition plug 17 ignites air-fuel mixture, and the ignitor-installed coil 21 applies a high voltage to the ignition plug 17. In each of the cylinders in the engine 10, the air-fuel mixture, which contains the suctioned air and the fuel injected by the injector 12, is ignited by the ignition plug 17 and burned. Exhaust gas after combustion is discharged through an exhaust pipe 18. In one embodiment, the exhaust pipe 18 may serve as an exhaust passage.

An air-fuel ratio sensor 19 is attached to a position on a downstream side of the aggregated exhaust pipes 18 and on an upstream side of an exhaust purification catalyst 20A. A linear air-fuel ratio sensor (an LAF sensor) is used as the air-fuel ratio sensor 19. The LAF sensor can output a signal that corresponds to oxygen concentration and unburned gas concentration in the exhaust gas (that is, a signal corresponding to an air-fuel ratio of the air-fuel mixture), and can linearly detect the air-fuel ratio.

The exhaust purification catalyst 20A is disposed on a downstream side of the LAF sensor 19. The exhaust purification catalyst 20A is a three-way catalyst (TWC), simultaneously performs oxidization of hydrocarbon (HC) and carbon monoxide (CO) and reduction of nitrogen oxide (NOx) in the exhaust gas, and thereby converts harmful gas components in the exhaust gas into harmless carbon dioxide ($CO_2$), water vapor ($H_2O$), and nitrogen ($N_2$).

On a downstream side of the exhaust purification catalyst 20A, a gasoline particulate filter (GPF) 20B is disposed to collect and remove particulate matter (PM) that are contained in the exhaust gas. That is, the exhaust purification catalyst 20A purifies HC, CO, and NOx, and thereafter the PMs are collected and removed while flowing through the GPF 20B. For example, a so-called closed (wall flow) GPF is used as the GPF 20B. In the closed (wall flow) GPF, heat-resistant ceramics such as cordierite have a honeycomb structure, and end surfaces on inlet and outlet sides of many cells, each of which serves as a gas passage, are sealed alternately. As described above, in the initial collection period (when the PM accumulation amount is small), filter holes of the GPF 20B are large, and the PM collection rate is low. Thereafter, as the collection (accumulation) of the PMs progresses, the filter holes are gradually reduced in size, and the PM collection rate is increased.

The muffler (silencer) 50 that reduces exhaust noise is coupled to a rear end of the exhaust pipe 18 (that is, on a downstream side of the GPF 20B). The muffler 50 has plural partition walls and the like that are disposed in a casing in a rectangular parallelepiped shape, a cylindrical shape, or an oval cylindrical shape, for example. The muffler 50 expands the exhaust gas stepwise, causes repeated interference of pressure waves, and the like, and thereby reduces a pressure and a temperature of the exhaust gas to reduce the exhaust noise. A pre-muffler that mainly reduces high-frequency noise may be disposed on an upstream side of the muffler (main muffler) 50. The muffler 50 will be described in detail below.

In the exhaust pipe 18, an exhaust gas recirculation (EGR) device 40 is provided that recirculates some of the exhaust gas discharged from the engine 10 into the intake manifold 11 of the engine 10. The EGR device 40 has: an EGR pipe 41 that communicates between the exhaust pipe 18 and the intake manifold 11 of the engine 10; and an EGR valve 42 that is interposed on the EGR pipe 41 and adjusts an exhaust gas recirculation rate (an EGR flow rate). An ECU 70, which will be described below, controls an opening degree (EGRSTP) of the EGR valve 42 according to the driving state of the engine 10.

In addition to the airflow meter 14, the LAF sensor 19, the vacuum sensor 30, and the throttle opening degree sensor 31 described above, a cam angle sensor 32 that determines the cylinder of the engine 10 is attached near the camshaft of the engine 10. Furthermore, a crank angle sensor 33 that detects a rotational position of the crankshaft 10*a* is attached near the crankshaft 10*a* of the engine 10. A timing rotor 33*a* is attached to an end of the crankshaft 10*a*. The timing rotor 33*a* has protrusions of 34 teeth at intervals of 10° with a lack of 2 teeth, for example. The crank angle sensor 33 detects the rotational position of the crankshaft 10*a* by detecting presence or absence of the protrusion of the timing rotor 33*a*. Both of the cam angle sensor 32 and the crank angle sensor 33 are electromagnetic pickup sensors, for example.

These sensors are coupled to the ECU 70. Various other sensors are also coupled to the ECU 70, and include a coolant temperature sensor 34 that detects a temperature of a coolant of the engine 10, an oil temperature sensor 35 that detects a temperature of lubricating oil, an accelerator sensor 36 that detects a depression amount of an accelerator pedal, that is, an operation amount of the accelerator pedal, a vehicle speed sensor 37 that detects a speed of the vehicle, and the like.

The ECU 70 has: a microprocessor that performs calculations; EEPROM that stores a program and the like, the program causing the microprocessor to executes each processing; RAM that stores various data such as calculation results; backup RAM, storage contents of which are held by a battery and the like; an input/output I/F; and the like. The ECU 70 further includes: an injector driver that drives the injector 12; an output circuit that outputs an ignition signal; a motor driver that drives an electric motor 13*a* opening/closing the electronically controlled throttle valve 13; and the like.

The ECU 70 determines the cylinder from output of the cam angle sensor 32, and calculates a rotation angular velocity and an engine speed from output of the crank angle sensor 33. In addition, based on detection signals that are received from the various sensors described above, the ECU 70 acquires various information such as an intake air amount, an intake pipe negative pressure, an accelerator pedal opening degree, the air-fuel ratio of the air-fuel mixture, and a coolant temperature and an oil temperature of the engine 10. Then, based on these acquired various information, the ECU 70 comprehensively controls the engine 10 by controlling a fuel injection amount, ignition timing, and various devices such as the throttle valve 13 and the EGR valve 42.

In one example, the muffler 50 constitutes the exhaust purification apparatus 1 that includes the GPF 20B, the PM collection rate of which is low in an initial use period (when the vehicle is brand new). The muffler 50 further reduces a PM discharge amount in the initial use period (when the vehicle is brand new).

For this reason, the muffler 50 includes therein a first exhaust passage 51 and a second exhaust passage 52 that are coupled to each other in parallel. Thus, on the downstream side of the GPF 20B, the first exhaust passage 51 and the second exhaust passage 52 are coupled to the exhaust pipe 18. In this embodiment, the first exhaust passage 51 and the second exhaust passage 52 are a common passage until reaching a secondary filter 53, which will be described below (that is, such a structure is adopted that the common passage is divided into the first exhaust passage 51 and the second exhaust passage 52 right before the secondary filter 53).

The secondary filter 53 is interposed on the first exhaust passage 51. Similar to the GPF 20B, a filter that can collect and remove the PMs is used as the secondary filter 53. A size and the like of the secondary filter 53 will be described below.

In an initial state of the GPF 20B (at a start of use of the GPF 20B), the first exhaust passage 51 communicates with a tail pipe 56 via the secondary filter 53. Then, after the start of use of the GPF 20B, the engine 10 keeps being driven, which causes accumulation of the PMs on the secondary filter 53 and eventually clogging of the secondary filter 53 with the PMs. As a result, the first exhaust passage 51 is closed, and the communication with the tail pipe 56 is blocked.

In the initial state of the GPF 20B (at the start of use of the GPF 20B), the second exhaust passage 52 is closed by a partition wall 501 and a liquid 57 (that is, communication with the tail pipe 56 is blocked). The partition wall 501 is provided above a liquid storage 58, which will be described below, and extends vertically downward and in a vehicle width direction. Here, water that is harmless and easily evaporated under an environment is used as the liquid 57. Then, after the start of use of the GPF 20B, the secondary filter 53 is clogged with the PMs, pressure loss of the secondary filter 53 is increased, and an exhaust pressure is increased. As a result, the liquid (water) 57 is discharged, and/or the liquid (water) 57 is evaporated, and thus the second exhaust passage 52 communicates with the tail pipe 56. The second exhaust passage 52 is an original passage (route) in the muffler 50.

In a bottom part of the muffler 50, an inclined plate 54 is disposed on a vehicle rear side in an inclined manner that a vehicle front side of the inclined plate 54 is located lower than a vehicle rear side, for example. The inclined plate 54 has a notch 541, from which the liquid (water) 57 is discharged. The notch 541 has a triangular shape with a vertex on a vehicle front side, for example. In addition, the liquid storage 58, which stores the liquid (water) 57, is provided on a bottom surface of the muffler 50, and is located on a side of the inclined plate 54 (the vehicle front side in this embodiment).

When the secondary filter 53 is clogged with the PMs to cause an increase in the pressure loss of the secondary filter 53 and an increase in the exhaust pressure, a liquid surface of the liquid (water) 57, which is stored in the liquid storage 58, is pressed vertically downward. As a result, the liquid (water) 57 flows onto the inclined plate 54 and is then discharged from the notch 541. When the liquid surface (a water surface) is lowered by the discharge of the liquid (water) 57, just as described, the second exhaust passage 52 is no longer closed, and the second exhaust passage 52 communicates with the tail pipe 56 (see the lower part of FIG. 2).

After the muffler 50 is assembled to a vehicle body, for example, the liquid (water) 57 is poured from the tail pipe 56, which protrudes from a rear end surface of the muffler 50, by using a hose. Accordingly, the inclined plate 54, which is disposed below the tail pipe 56, has a groove 55 that extends in a vehicle front-rear direction. The groove 55 guides the liquid (water) 57, which is poured from the tail pipe 56, into the liquid storage 58 while avoiding the notch 541.

At a predetermined timing (for example, a timing at which the vehicle travels for a predetermined distance, a timing at which a predetermined engine driving period elapses, or the like) from the initial state of the GPF 20B (after the start of use of the GPF 20B), the exhaust passage is switched from the first exhaust passage 51 to the second exhaust passage 52. For such a purpose, for example, a relationship among a produced amount of the PMs, the pressure loss of the secondary filter 53, and the exhaust pressure, a relationship between the exhaust pressure and a liquid level (water level), a relationship between an exhaust temperature and an evaporation amount of the liquid (water) 57, and the like are taken into consideration to set (adjust) the size (for example, a diameter, a thickness, and sizes of holes) and collection performance of the secondary filter 53 to be used, an amount of the liquid (water) 57 to be poured, an inclination angle of the inclined plate 54, a shape, a size, and a position of the notch 541, a vertical length of the partition wall 501, and the like.

In one example, in a manner to switch the exhaust passage in approximately 1 to 5 driving cycles (50 to 500 km), the size and the collection performance of the secondary filter 53, the amount of the liquid (water) 57, the inclination angle of the inclined plate 54, the shape, the size, and the position of the notch 541, the vertical length of the partition wall 501, which are described above, and the like are set (adjusted). In addition, each of the above parameters is set to prevent the exhaust pressure from being increased abnormally when the secondary filter 53 is closed.

With the above-described configuration, in the initial state of the GPF 20B (at the start of use with the low PM collection rate (when the vehicle is new)), the first exhaust passage 51 communicates with the tail pipe 56 via the secondary filter 53, while the second exhaust passage 52 is closed by the liquid (water) 57. Accordingly, the exhaust gas flows through the first exhaust passage 51, and the PMs that are not collected or removed by the GPF 20B are collected and removed by the secondary filter 53 and then discharged from the tail pipe 56 (see one-dot chain arrows in the drawings in the upper part of FIG. 2). Furthermore, since the secondary filter 53 is disposed in the muffler 50 (on the downstream side of the GPF 20B), the PMs that may be produced on the downstream side of the GPF 20B when the vehicle is new are collected and removed.

Thereafter (after the start of use), as the engine 10 keeps being driven, the PMs keep being accumulated on the secondary filter 53 and eventually clog the secondary filter 53. As a result, the first exhaust passage 51 is closed. Meanwhile, the second exhaust passage 52 communicates with the tail pipe 56 when the secondary filter 53 is clogged with the PMs to cause the increase in the pressure loss of the secondary filter 53 and the increase in the exhaust pressure, and thus the liquid (water) 57 is discharged from the notch 541 of the inclined plate 54 and/or the liquid (water) 57 is evaporated. At the time, the PM collection rate of the GPF 20B is high. Accordingly, after the PMs in the exhaust gas are collected and removed by the GPF 20B, the exhaust gas flows through the second exhaust passage 52 with the lower pressure loss than the secondary filter 53 and is then discharged from the tail pipe 56 (see broken arrows in the drawing in the lower part of FIG. 2).

As it has been described in detail so far, according to this embodiment, in the initial state of the GPF 20B (at the start of use with the low PM collection rate (when the vehicle is new)), the first exhaust passage 51 communicates with the tail pipe 56 via the secondary filter 53, and the second exhaust passage 52 is closed by the liquid (water) 57. Thus, the secondary filter 53 can collect and remove the PMs that are not collected and removed by the GPF 20B due to the flow of the exhaust gas through the first exhaust passage 51. In addition, since the secondary filter 53 is disposed in the muffler 50 (on the downstream side of the GPF 20B), it is also possible to collect and remove the PMs that may be produced on the downstream side of the GPF 20B when the vehicle is new. As a result, it is possible to further reduce the PM discharge amount in the initial use period (when the vehicle is new).

Thereafter (after the start of use), as the engine 10 keeps being driven, the PMs clog the secondary filter 53. As a result, the first exhaust passage 51 is closed. Meanwhile, the second exhaust passage 52 communicates with the tail pipe 56 when the secondary filter 53 is clogged with the PMs to cause the increase in the pressure loss of the secondary filter 53 and the increase in the exhaust pressure, and thus the liquid (water) 57 is discharged and/or the liquid (water) 57 is evaporated. At the time, the PM collection rate of the GPF 20B is high. Thus, after the PMs are collected and removed by the GPF 20B, the exhaust gas can be discharged from the tail pipe 56 through the second exhaust passage 52 (after exhaust noise is lowered).

According to this embodiment, the size of the secondary filter 53, the amount of the liquid (water) 57, and the like are set such that the exhaust passage is switched from the first exhaust passage 51 to the second exhaust passage 52 at the predetermined timing (the timing at which the vehicle travels for the predetermined distance, the predetermined driving period, or the like) from the initial state of the GPF 20B (after the start of use of the GPF 20B). Thus, it is possible to accurately switch the exhaust passage from the first exhaust passage 51 to the second exhaust passage 52 at the predetermined timing (the timing at which the vehicle travels for the predetermined distance, the predetermined driving period, or the like) from the initial state of the GPF 20B (after the start of use of the GPF 20B).

According to this embodiment, since the first exhaust passage 51 and the second exhaust passage 52 are disposed in the muffler 50, the secondary filter 53 can be disposed on the most downstream side (at a downstream end) of the exhaust pipe 18. In addition, since the first exhaust passage 51 (the secondary filter 53) and the second exhaust passage 52 (the inclined plate 54) are assembled in the muffler 50, it is possible to reduce a space, cost, and the like in comparison with a case where a dedicated casing, pipe, and the like are newly provided.

According to this embodiment, the inclined plate 54 having the notch 541 is disposed in the muffler 50. When the secondary filter 53 is clogged with the PMs to cause the increase in the pressure loss of the secondary filter 53 and the increase in the exhaust pressure, the liquid surface of the liquid (water) 57 is pressed vertically downward. As a result, the liquid (water) 57 flows onto the inclined plate 54 and is then discharged from the notch 541. Thus, when the secondary filter 53 is clogged with the PMs to cause the increase in the pressure loss of the secondary filter 53 and the increase in the exhaust pressure, it is possible to accurately cancel closure of the second exhaust passage 52 by discharging the liquid (water) 57 from the notch 541, that is, lowering the liquid level (water level).

According to this embodiment, the inclined plate 54 has the groove 55. The groove 55 guides the liquid (water) 57, which is poured from the tail pipe 56 protruding from the muffler 50, into the liquid storage 58 while avoiding the notch 541. Thus, when the liquid (water) 57 is poured from the tail pipe 56, the liquid (water) 57 can be accurately guided to the liquid storage 58 (that is, without being leaked from the notch 541).

First Modified Example

Figure 4:
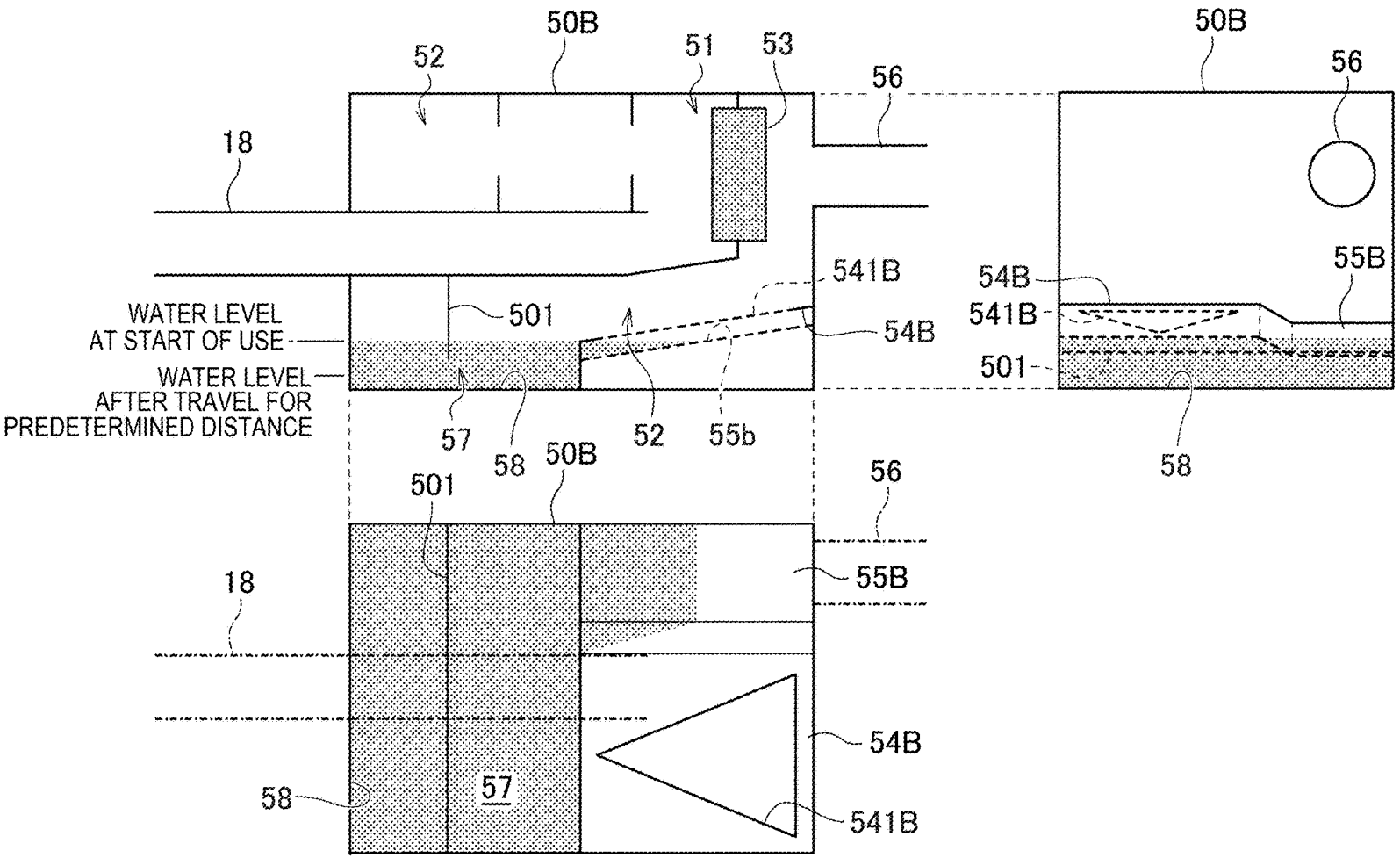
FIG. 4 includes a cross-sectional view, a front view, and a plan view, each of which illustrates a configuration of a muffler constituting an exhaust purification apparatus according to a modified example.

In the above embodiment, the tail pipe 56 and the groove 55 of the inclined plate 54 are disposed at the center of the muffler 50 in the vehicle width direction, and the notch 541 is provided on both of the sides of the inclined plate 54 (the groove 55). However, as illustrated in FIG. 4, for example, the tail pipe 56 and a groove 55B of an inclined plate 54B may be disposed on the right side (or the left side) of a muffler 50B in the vehicle width direction, and a notch 541B may be provided on the left side (or the right side) of the inclined plate 54B in the vehicle width direction. FIG. 4 includes a cross-sectional view, a front view, and a plan view of a configuration of the muffler 50B that constitutes an exhaust purification apparatus according to a first modified example. Since the rest of the configuration is the same as or similar to that in the above embodiment (of the above-described muffler 50), the detailed description thereon will not be made herein.

This modified example can also exert the same effect as that in the above embodiment. That is, it is possible to further reduce the PM discharge amount in the initial use period (when the vehicle is brand new).

Second Modified Example

Figure 5:
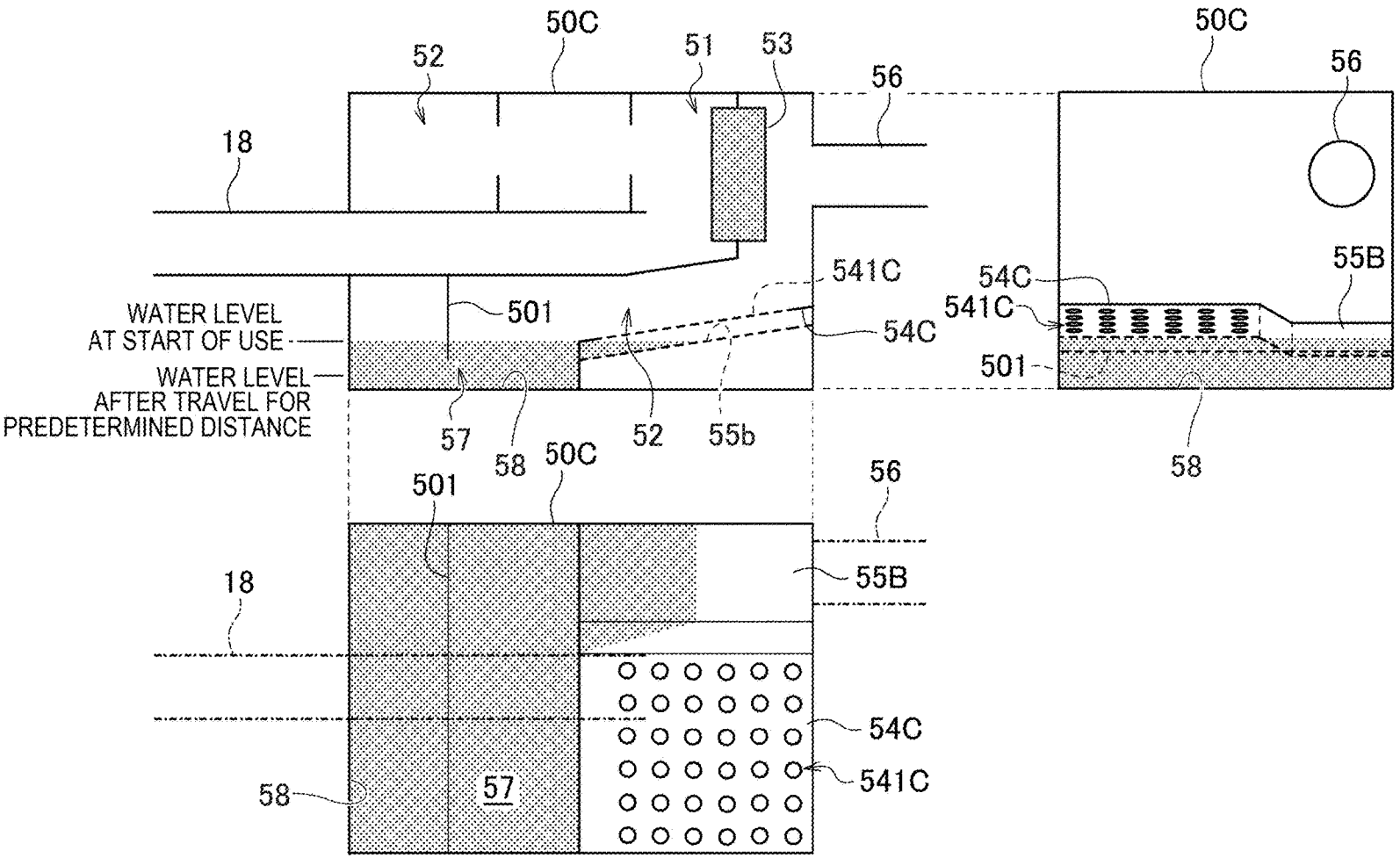
FIG. 5 includes a cross-sectional view, a front view, and a plan view, each of which illustrates a configuration of a muffler constituting an exhaust purification apparatus according to a modified example.

As illustrated in FIG. 5, instead of the notch 541 of the inclined plate 54, the inclined plate 54 may be entirely or partially a punched mesh 541C (obtained by punching an inclined plate 54C to make plural holes). FIG. 5 includes a cross-sectional view, a front view, and a plan view of a configuration of a muffler 50C that constitutes an exhaust purification apparatus according to a second modified example. Since the rest of the configuration is the same as or similar to that in the above first modified example, the detailed description thereon will not be made herein.

This modified example can also exert the same effect as that in the above embodiment. That is, it is possible to further reduce the PM discharge amount in the initial use period (when the vehicle is brand new). In addition, according to this modified example, it is possible to improve a muffling effect using the punched mesh 541C.

The description has been made so far on the embodiment of the disclosure. However, the disclosure is not limited to the above embodiment, and various modifications can be made thereto. For example, in the above embodiment, the description has been made on the example in which the disclosure is applied to the in-cylinder injection engine (gasoline engine) 10 including the GPF 20B. However, the disclosure can also be applied to a diesel engine that includes a DPF, for example.

In the above embodiment, the first exhaust passage 51 and the second exhaust passage 52 are the common passage until reaching the secondary filter 53. However, for example, such a structure may be adopted that the exhaust passage is divided into the first exhaust passage 51 and the second exhaust passage 52 at a position on an upstream side of and away from the secondary filter 53.

Furthermore, the shape of the notch 541 of the inclined plate 54 is not limited to the triangular shape, and may be another shape according to a requirement or the like.

Moreover, it may be configured to further include a weight, for example, in order to prevent the discharge of the liquid (water) from the notch 541 of the inclined plate 54 on an uphill road, during rapid acceleration, or the like, and include a plate (shielding plate) that automatically slides to the vehicle rear side and entirely or partially closes the notch 541 of the inclined plate 54 on the uphill road, the rapid acceleration, or the like.

According to the exhaust purification apparatus in one aspect of the disclosure, in the initial state of the particulate filter (at the start of use with the low PM collection rate (when the vehicle is new)), the first exhaust passage communicates with the tail pipe via the secondary filter, and the second exhaust passage is closed by the liquid (communication with the tail pipe is blocked). Thus, it is possible to collect and remove the PMs, which are not collected and removed by the particulate filter due to the flow of the exhaust gas through the first exhaust passage, by the secondary filter. In addition, since the secondary filter is disposed on the downstream side of the particulate filter, it is also possible to collect and remove the PMs that may be produced on the downstream side of the particulate filter when the vehicle is new. Thereafter (after the start of use), as the engine keeps being driven, the collected PMs clog the secondary filter. As a result, the first exhaust passage is closed. Meanwhile, the second exhaust passage communicates with the tail pipe when the secondary filter is clogged with the PMs to cause the increase in the pressure loss of the secondary filter and the increase in the exhaust pressure, and thus the liquid is discharged and/or the liquid is evaporated. At the time, the PM collection rate of the particulate filter is high. Thus, after the PMs are collected and removed by the particulate filter, the exhaust gas can be discharged from the tail pipe through the second exhaust passage.

In recent years, spread of direct injection (in-cylinder injection) by gasoline engines promotes reinforcement of regulations of particulate matter (PM) on the gasoline engines (in one example, introduction of a regulation of a particulate number (PN) to regulate the number of the PMs, in addition to a regulation on weight of the PMs). In order to comply with such PM regulations and PN regulations, Japanese Unexamined Patent Application Publication No. 2015-222028 and the like disclose a gasoline particulate filter (GPF) and the like. The GPF collects and removes the PMs contained in exhaust gas of the engine.

However, continuous use of the GPF, a diesel particulate filter (DPF), or the like (hereinafter collectively referred to as a "particulate filter") causes clogging by the collected PMs. To handle such a problem, regenerative processing is executed on the particulate filter to burn and remove the collected (accumulated) PMs at a timing at which the PMs are collected to some extent. The entire contents of this publication are incorporated herein by reference.

An aspect of the disclosure provides an exhaust purification apparatus configured to purify exhaust gas discharged from an engine. The exhaust purification apparatus includes a particulate filter, a first exhaust passage, and a second exhaust passage. The particulate filter is configured to collect and remove particulate matter. The first exhaust passage and the second exhaust passage are coupled in parallel to each other and coupled to an exhaust passage on a downstream side of the particulate filter. The first exhaust passage communicates with a tail pipe via a secondary filter in an initial state of the particulate filter. The secondary filter is configured to collect and remove the particulate matter. After a start of use of the particulate filter, communication of the first exhaust passage with the tail pipe is blocked when the secondary filter is clogged with the collected particulate matter. The second exhaust passage is closed by a liquid in the initial state of the particulate filter. After the start of use of the particulate filter, the second exhaust passage communicates with the tail pipe when the secondary filter is clogged with the particulate matter to cause an increase in pressure loss of the secondary filter and an increase in an exhaust pressure, and thus one or both of discharge of the liquid and evaporation of the liquid occurs.

A PM collection rate of the particulate filter varies by a PM collection amount (accumulation amount). In one example, in an initial collection period (when the PM accumulation amount is small), holes of the particulate filter are large, and the PM collection rate is low. Thereafter, as the collection (accumulation) of the PMs progresses, the filter holes are gradually reduced in size, and the PM collection rate is increased.

The particulate filter is commonly installed immediately below the engine or under a floor near the engine. Accordingly, the particulate filter does not collect the PMs that are produced by residual processing oil or the like in an exhaust pipe when a vehicle is new. The exhaust pipe is located on a downstream side of the particulate filter. For this reason, in an initial use period (when the vehicle is new), a PM discharge amount by the vehicle including the particulate filter tends to be large.

It is desirable to provide an exhaust purification apparatus that includes a particulate filter collecting and removing PMs and can further reduce a PM discharge amount in an initial use period (when a vehicle is new).

Obviously, numerous modifications and variations of the present invention are possible in light of the above teachings. It is therefore to be understood that within the scope of the appended claims, the invention may be practiced otherwise than as specifically described herein.

The invention claimed is:

1. An exhaust purification apparatus for purifying exhaust gas discharged from an engine, comprising:

a particulate filter configured to collect and remove particulate matter;

a secondary filter configured to collect and remove the particulate matter; and a plurality of exhaust passages comprising a first exhaust passage and a second exhaust passage coupled in parallel to each other and coupled to an exhaust passage on a downstream side of the particulate filter, wherein the first exhaust passage is configured to communicate with a tail pipe via the secondary filter in an initial state of the particulate filter, and the second exhaust passage is configured to be closed by a liquid in the initial state of the particulate filter and communicate with the tail pipe after the start of use of the particulate filter when the secondary filter is clogged with the particulate matter and communication of the first exhaust passage with the tail pipe is blocked to cause an increase in pressure loss of the secondary filter and an increase in an exhaust pressure such that discharge of the liquid and/or evaporation of the liquid occurs.

2. The exhaust purification apparatus according to claim 1, wherein a size of the secondary filter and an amount of the liquid are set such that an exhaust passage is switched from the first exhaust passage to the second exhaust passage at a predetermined timing from the initial state of the particulate filter.

3. The exhaust purification apparatus according to claim 2, wherein the first exhaust passage and the second exhaust passage are interposed on the exhaust passage and disposed in a muffler configured to lower exhaust noise.

4. The exhaust purification apparatus according to claim 3, further comprising:

an inclined plate having a notch and positioned to be inclined in the muffler, wherein when the secondary filter is clogged with the particulate matter to cause the increase in the pressure loss of the secondary filter and the increase in the exhaust pressure, a liquid surface of the liquid is pressed vertically downward such that the liquid flows onto the inclined plate and is discharged from the notch.

5. The exhaust purification apparatus according to claim 4, wherein the inclined plate has a groove configured to guide the liquid that is poured from the tail pipe protruding from the muffler into a liquid storage while avoiding the notch, and the liquid storage is positioned on a bottom surface of the muffler and on a side of the inclined plate.

* * * * *